US006485328B1

(12) United States Patent
Wu

(10) Patent No.: US 6,485,328 B1
(45) Date of Patent: Nov. 26, 2002

(54) HEADER CONNECTOR WITH SHELL

(75) Inventor: Jerry Wu, Pan-Chiao (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/028,642

(22) Filed: Dec. 19, 2001

(51) Int. Cl.[7] ..... H01R 13/73
(52) U.S. Cl. ..... 439/567; 439/609
(58) Field of Search ..... 439/607, 609, 439/567, 78

(56) References Cited

U.S. PATENT DOCUMENTS 4,718,867 A * 1/1988 Seidel et al. ..... 439/609
5,441,423 A * 8/1995 Champion et al. ..... 439/567
5,738,541 A * 4/1998 Tseng ..... 439/567
6,227,879 B1 * 5/2001 Dong ..... 439/567

* cited by examiner

*Primary Examiner*—Gary Paumen
(74) *Attorney, Agent, or Firm*—Wei Te Chung

(57) ABSTRACT

An electrical connector (1) comprises an insulative housing (2), a number of terminals (3) received in the housing and a shell (4) enclosing the housing for electromagnetic interference protection. The housing has a number of grooves (242) defined in longitudinal walls (204) and a pair of projections (25) formed on lateral walls (206). The shell comprises a number of tags (42) secured in the grooves, a pair of downwardly extending board locks (44) interfering with the projections, and a number of tabs (45') integrally extending from lateral walls (412) thereof to engage with recesses (29') of the housing.

1 Claim, 9 Drawing Sheets

HEADER CONNECTOR WITH SHELL

BACKGROUND OF THE INVENTION

1. Field of the Invention

The present invention relates to a header connector, and particularly to a header connector with a securely assembled shell for EMI (Electromagnetic Interference) protection.

2. Description of Related Art

Almost every computer is equipped with a header connector for engaging with a cable end connector which connects with a hard disk drive to establish an electrical connection between the hard disk drive and a printed circuit board on which the header connector is mounted. A conventional header connector comprises an elongate insulative housing having two longitudinal walls and two lateral walls, and a plurality of pin-type terminals retained in the housing. Each terminal includes a mating portion for electrically engaging with a corresponding terminal of a complementary cable end connector, and a tail portion for electrical connection with a printed circuit board. However, when it is required that the header connector carry out high speed data transmission between the printed circuit board and the hard disk drive, electromagnetic or radio frequency interference increases. Therefore, a shell is employed to enclose the insulative housing of the header connector for EMI protection. The shell includes a pair of grounding legs integrally and downwardly extending from opposite ends thereof. When the header connector is mounted on the printed circuit board, the grounding legs are inserted into corresponding positioning holes of the printed circuit board for grounding.

However, because the longitudinal walls of the insulative housing are too long, the shell may not completely abut against the longitudinal walls of the housing without additional retaining means. As a result, the EMI protection of the header connector may be adversely affected. Furthermore, when the grounding legs of the shell are inserted into the positioning holes of the printed circuit board, the shell is easy to separate from the housing.

Hence, a header connector with a securely assembled shell is required to overcome the disadvantages of the related art.

SUMMARY OF THE INVENTION

Accordingly, one object of the present invention is to provide a header connector with a shell tightly enclosing an insulative housing thereof for complete electromagnetic interference protection.

Another object of the present invention is to provide a header connector with a shell which has a pair of board locks securely engaged with an insulative housing for facilitating insertion into a printed circuit board.

In order to achieve the objects set forth, a header connector with a shell in accordance with the present invention comprises an elongate insulative housing which has longitudinal walls and lateral walls, a plurality of terminals retained in the housing, and a shell securely assembled to the housing. The housing has a plurality of grooves defined in the longitudinal walls and a pair of projections formed on the lateral walls. Each projection has an outer head and an inner neck integrally connecting with the housing. The shell has a plurality of tags formed on longitudinal walls thereof for being secured in the grooves of the housing, a pair of board locks downwardly extending from lateral walls thereof for interfering with the neck of the projection, and a pair of tabs integrally formed on lateral walls and bent inwardly to engage with recesses defined in a mounting face of the housing. Thus, the shell fixedly encloses the housing for complete electromagnetic interference protection.

Other objects, advantages and novel features of the invention will become more apparent from the following detailed description when taken in conjunction with the accompanying drawings.

DETAILED DESCRIPTION OF THE INVENTION

Figure 1:
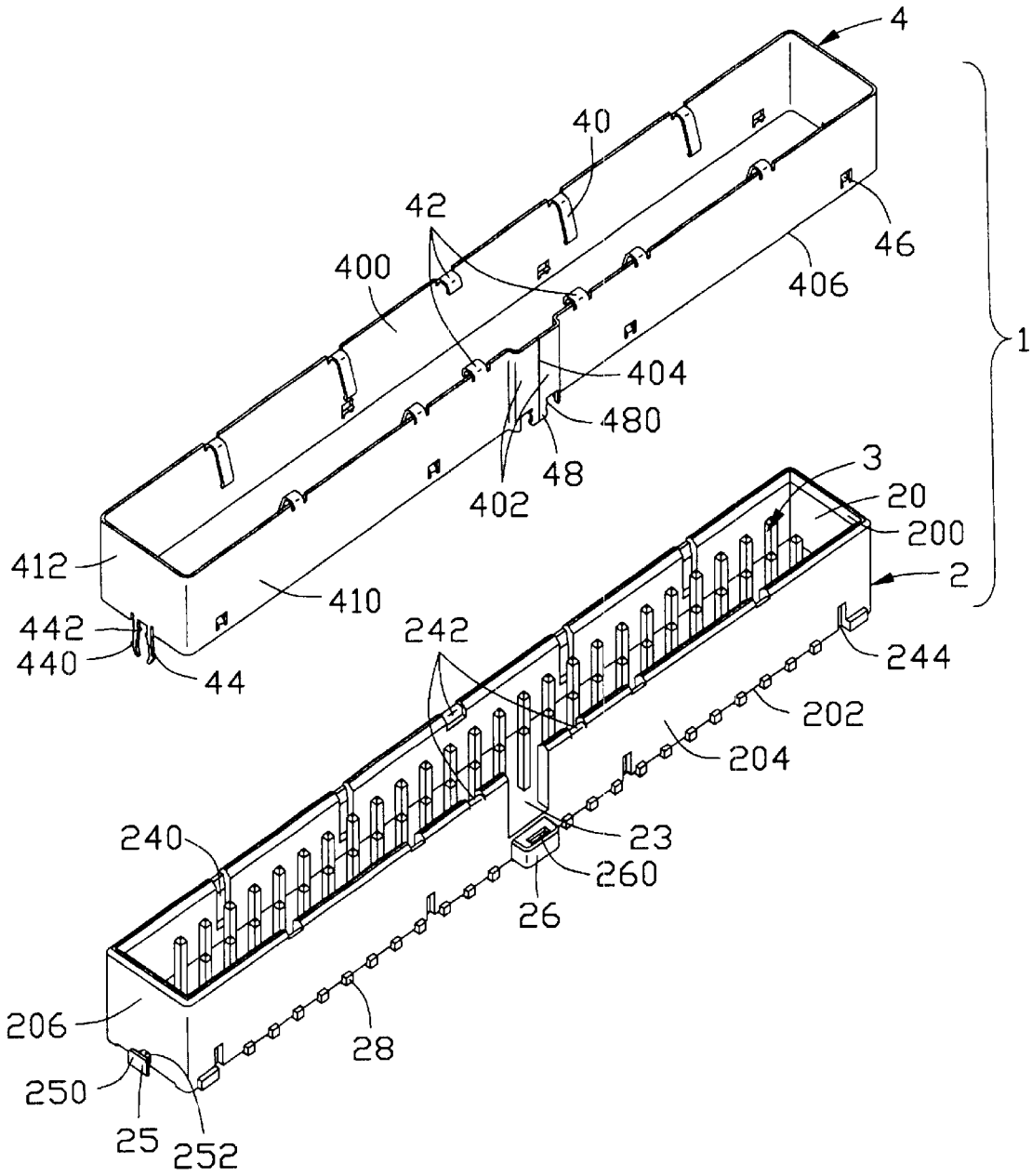
FIG. 1 is a partially exploded, perspective view of a header connector with a shell in accordance with a first embodiment of the present invention.
Figure 2:
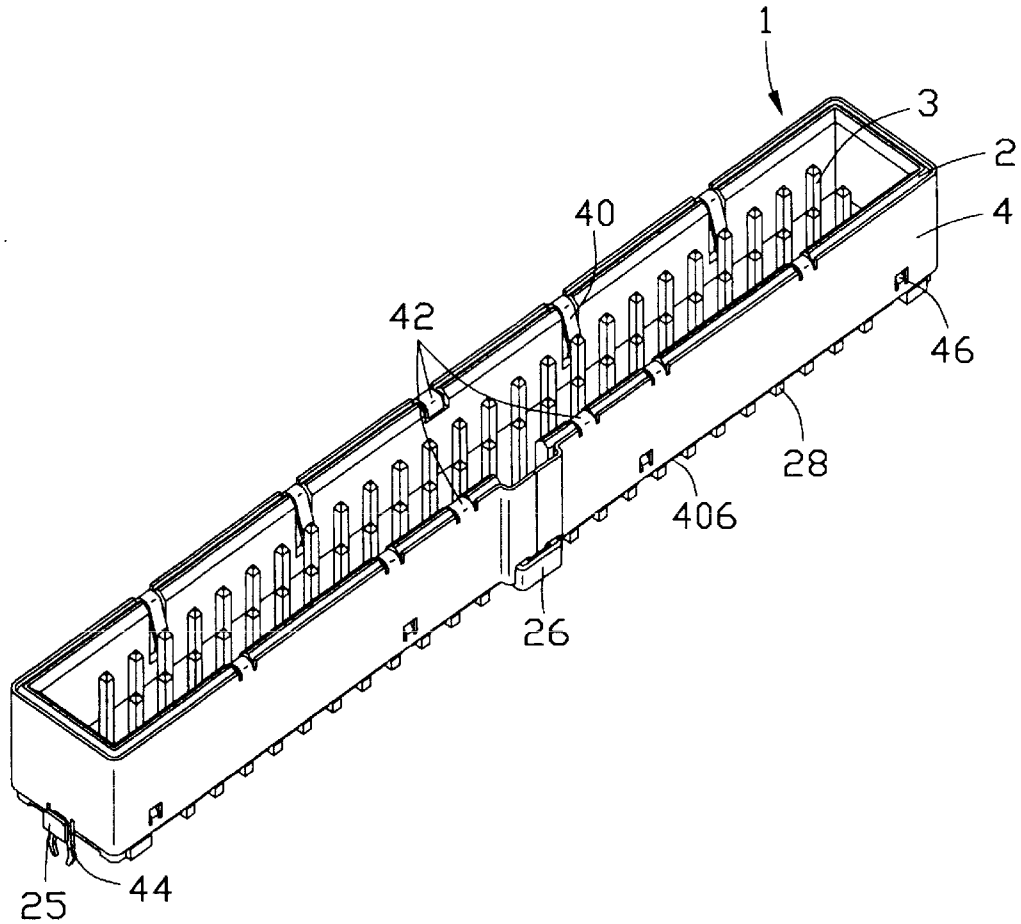
FIG. 2 is an assembled, perspective view of the header connector in FIG. 1.
Figure 3:
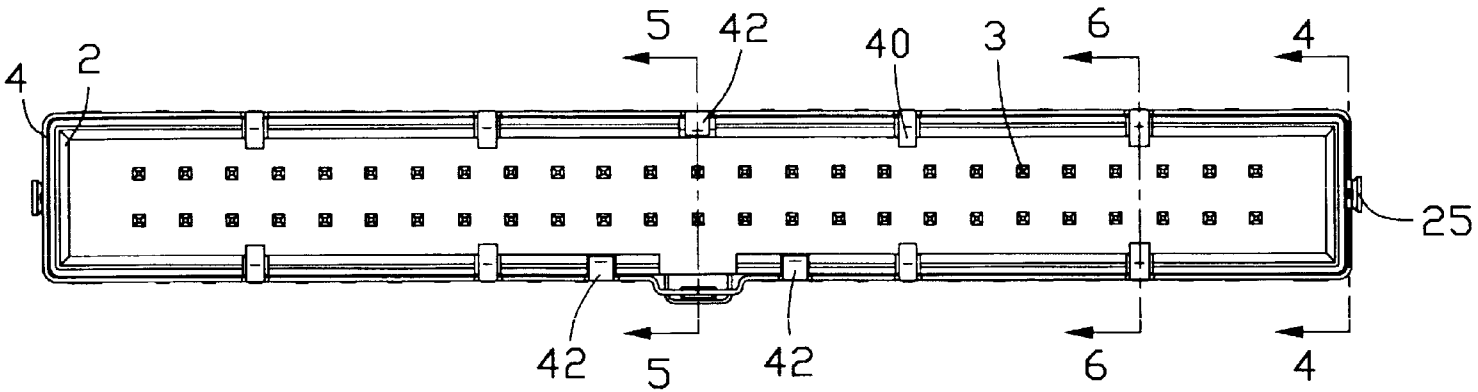
FIG. 3 is a top, plan view of the header connector in FIG. 2.
Figure 6:
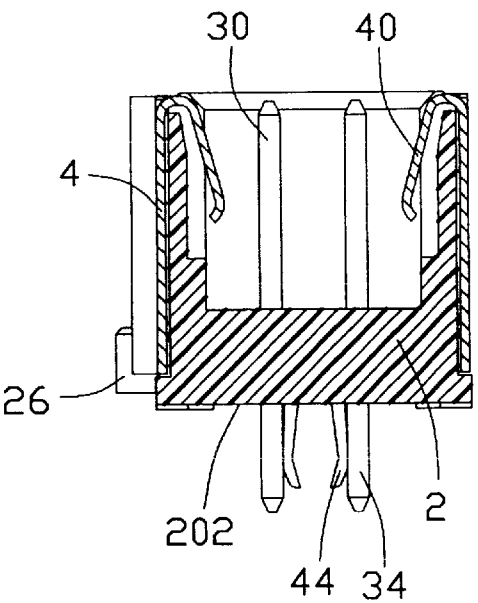
FIG. 6 is a cross-sectional view of the header connector taken along section line 6—6 in FIG. 3.

Referring to FIG. 1, a header connector 1 in accordance with a first embodiment of the present invention comprises an elongate insulative housing 2, a plurality of pin-type terminals 3 retained in the housing 2, and a metal shell 4 for enclosing the housing 2 for EMI protection.

The housing 2 defines a receiving cavity 20 through a mating face 200, and a plurality of passageways 22 (FIG. 5) upwardly extending from a mounting face 202 to communicate with the receiving cavity 20. For polarization and alignment purposes, the housing 2 defines a cutout 23 in a longitudinal wall 204 communicating with the receiving cavity 20 for properly engaging with a corresponding projection formed on a complementary cable end connector (not shown).

Figure 4:
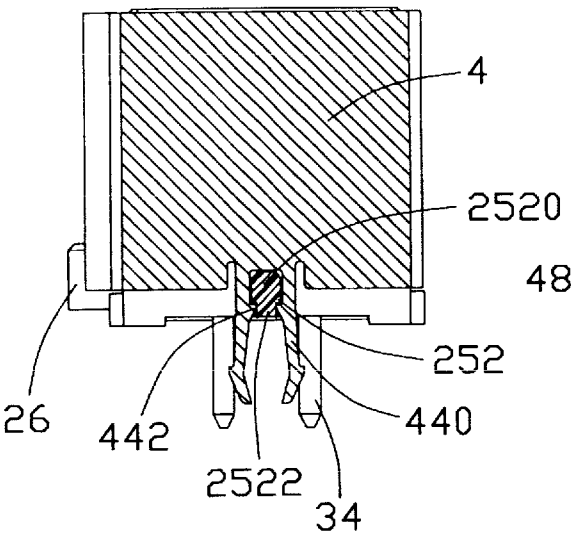
FIG. 4 is a cross-sectional view of the header connector taken along section line 4—4 in FIG. 3.
Figure 7:
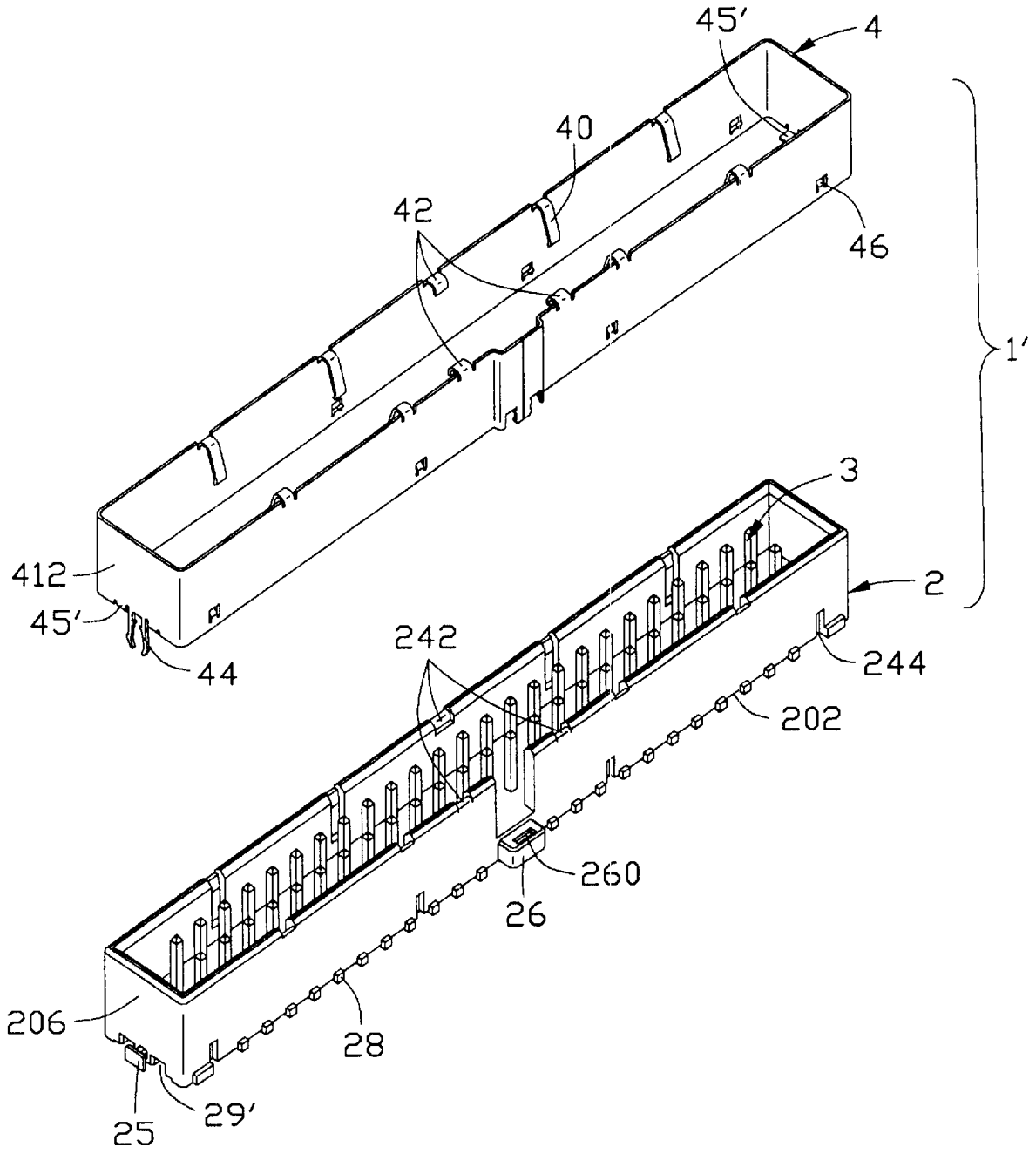
FIG. 7 is a partially exploded, perspective view of a header connector with a shell in accordance with a second embodiment of the present invention.
Figure 8:
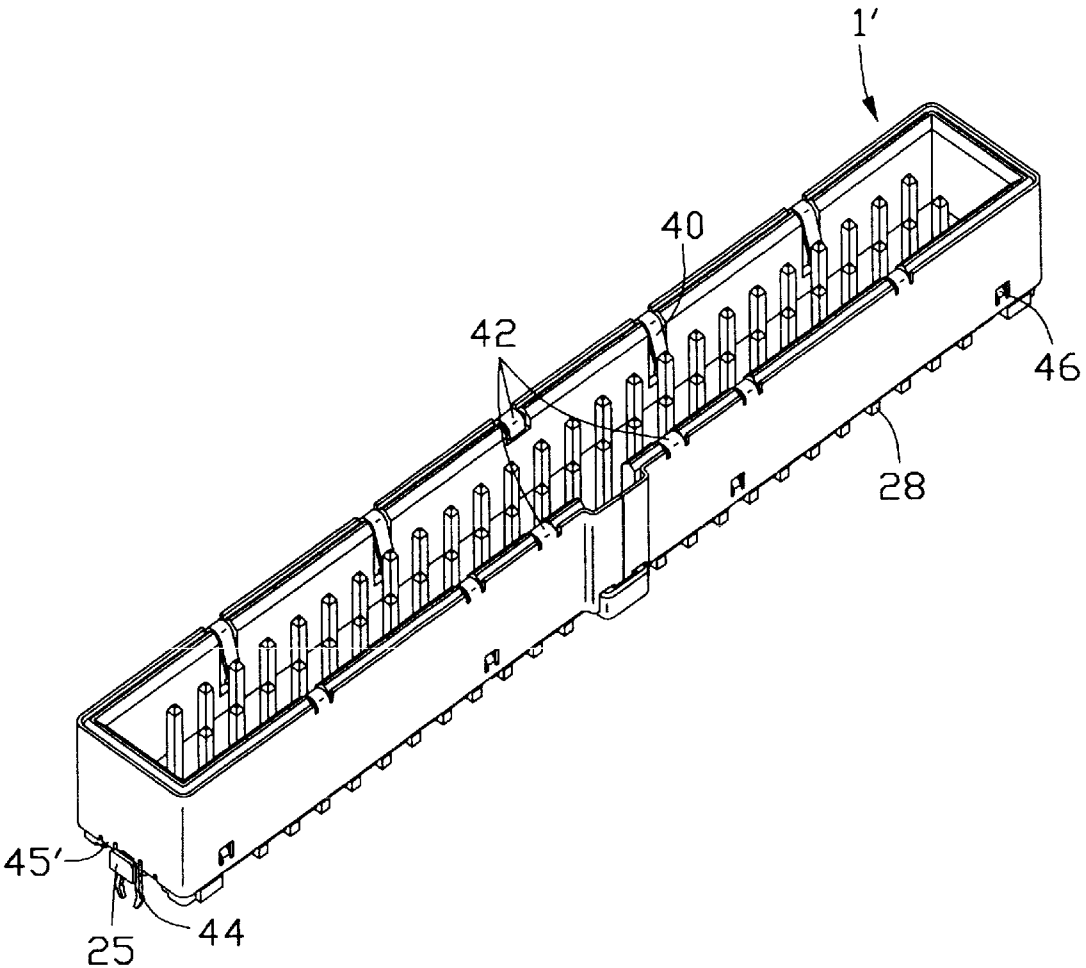
FIG. 8 is an assembled, perspective view of the header connector in FIG. 7.
Figure 9:
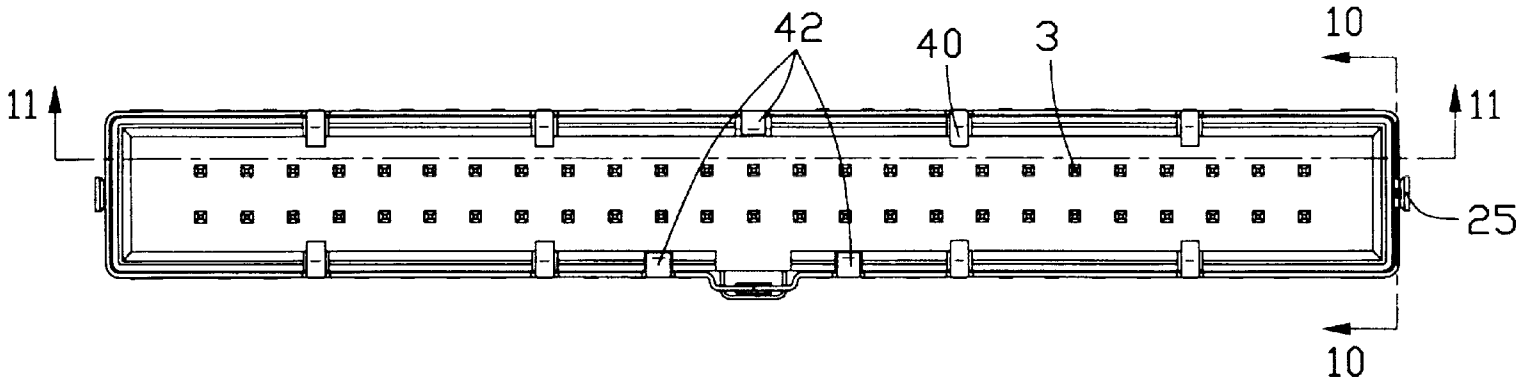
FIG. 9 is a top, plan view of the header connector in FIG. 8.
Figure 10:
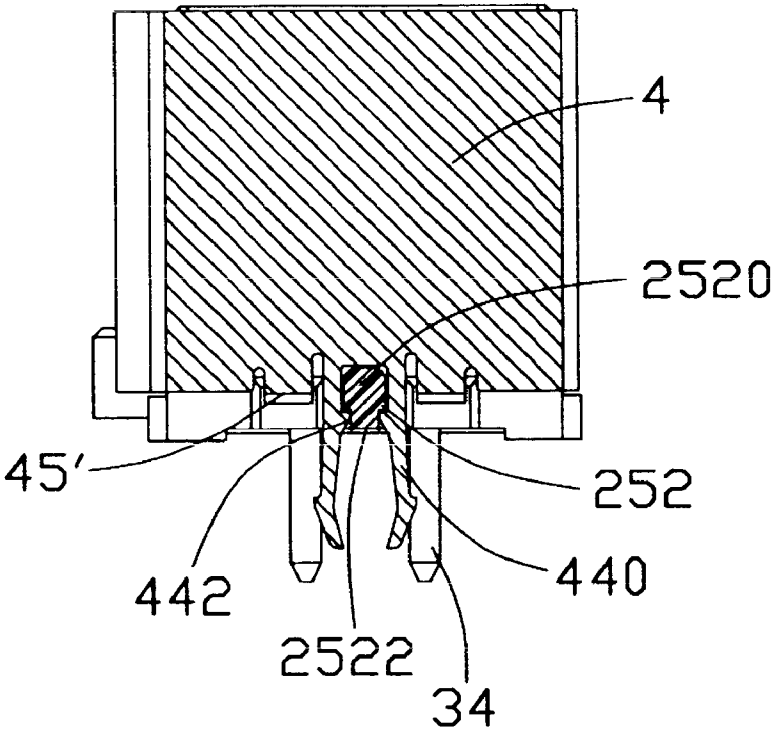
FIG. 10 is a cross-sectional view of the header connector taken along section line 10—10 in FIG. 9.
Figure 11:
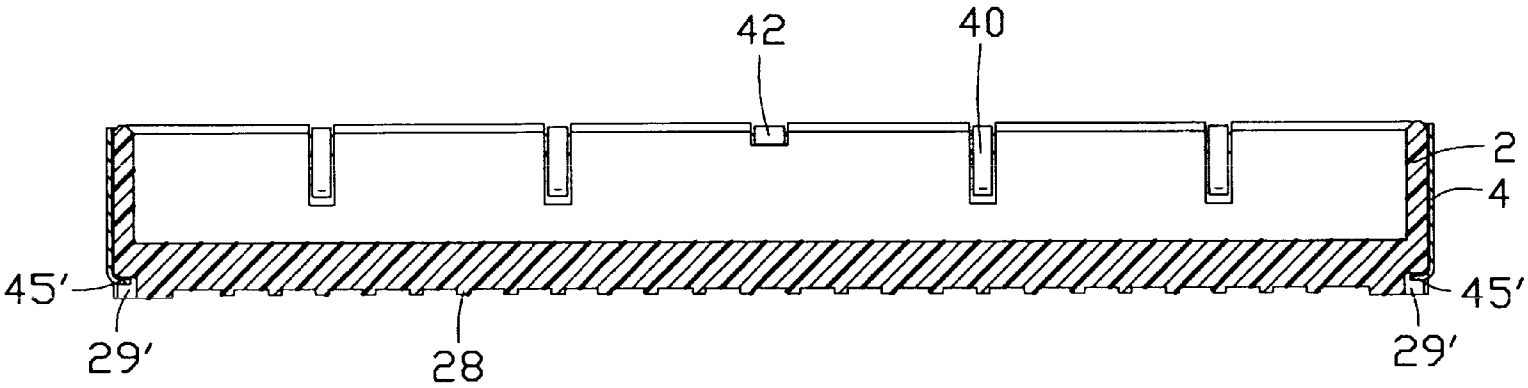
FIG. 11 is a cross-sectional view of the header connector taken along section line 11—11 in FIG. 9.

The housing 2 defines a plurality of recesses 240 and a plurality of grooves 242 in the longitudinal walls 204 in communication with the cavity 20, and a plurality of slots 244 at junction of the longitudinal walls 204 and the mounting face 202. A pair of projections 25 is formed on lateral walls 206 of the housing 2. Each projection 25 has an outer head 250 and an inner neck 252 integrally connecting with the housing 2. As clearly seen in FIG. 4, the neck 252 is generally of a T-shaped configuration and includes a large-dimensioned upper portion 2520 and a small-dimensioned lower portion 2522. An embossment 26 having an aperture 260 defined therein projects outwardly from one longitudinal wall 204 and below the cutout 23. A plurality of protrusions 28 is formed on the longitudinal walls 204 of the housing 2 adjacent to the mounting face 202.

Figure 5:
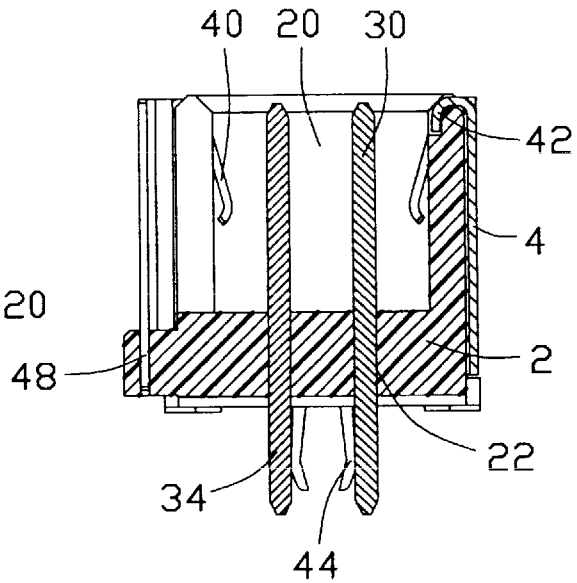
FIG. 5 is a cross-sectional view of the header connector taken along section line 5—5 in FIG. 3.

Also referring to FIG. 5, the pin-type terminals 3 are received in the passageways 22 of the housing 2. Each terminal 3 includes a mating portion 30 disposed in the cavity 20 for engaging with a corresponding terminal of the complementary cable end connector, and a tail portion 34 projecting beyond the mounting face 202 of the housing 2 for electrical connection with a printed circuit board (not shown) on which the connector 1 is mounted.

The shell 4 is stamped to be of a single metal blank, with an elongated body portion 400 and a pair of opposite end portions 402. Each end portion 402 has a downward extension 48 integrally extending therefrom. The extension 48 has a plurality of barbs 480. The body portion 400 includes two longitudinal and two lateral walls 410, 412. Each end portion 402 first extends outwardly, or in a direction generally transverse to the longitudinal extent of the body portion 400, and then extends longitudinally relative to the body portion 400. Finally, the end portions 402 are joined with a seam 404 left therebetween to shape the shell 4 in a rectangular box-like form.

The shell 4 is provided with a plurality of spring arms 40 integrally extending therefrom and bent downwardly to be disposed in the cavity 20, a plurality of inwardly extending tongues 46 integrally punched therefrom, and a plurality of tags 42 integrally formed on longitudinal walls 410 thereof and downwardly bent for being secured in the grooves 242 of the housing 2. In the preferred embodiment of the present invention, the tags 42 are arranged in a triangular shape, i.e., a pair of tags 42 is located adjacent to the extensions 48 of the shell 4 and another tag 42 is located opposite to the extensions 48. In addition, a pair of board locks 44 downwardly extends from a base, i.e., bottom portions of the lateral walls 412 of the shell 4 for locking the housing to the printed circuit board. Each board lock 44 has a pair of spaced legs 440 for straddling the neck 252 and abutting against the head 250 of a corresponding projection 25, and a pair of inwardly extending barbs 442 formed on inner sides of the spaced legs 440 for latching beneath the upper portion 2520 and interfering with the lower portion 2520 of the neck 252.

Referring to FIGS. 2–6, in assembly, the shell 4 is assembled to the housing 2 from the mating face 200 in a vertical direction. The spring arms 40 of the shell 4 are aligned with the recesses 240 of the housing 2 for resiliently engaging with a shell or an insulative housing of the complementary cable end connector. The tags 42 are received and retained in the grooves 242 of the housing 2 for securing the longitudinal walls 410 of the shell 4 against the longitudinal walls 204 of the housing 2. The barbs 442 of the board locks 44 latch beneath the upper portion 2520 and interfere with the lower portion 2522 of the neck 252 of the projection 25 for preventing the shell 4 from separating from the housing 2. The tongues 46 engage with the slots 244 of the housing 2 for stopping the shell 4 from moving upwardly. The extensions 48 of the shell 4 are received and retained in the aperture 260 of the housing 2 by an interferential engagement therebetween, whereby the end portions 402 of the shell 4 are closely abutting each other with no seam left therebetween. In addition, a pair of longitudinal bottom edges 406 of the shell 4 abuts against the protrusions 28 of the housing 2 for stopping the shell 4 from moving downwardly. Thus, the shell 4 securely encloses the housing 2 and complete EMI protection is ensured.

When the header connector 1 is mounted on the printed circuit board, the board locks 44 of the shell 4 are received within corresponding positioning holes of the printed circuit board, and the spaced legs 440 are compressed to deflect inwardly to further make the barbs 442 tightly engaging with the neck 252 of the projection 25 on the housing 2.

FIGS. 7–11 show a header connector 1' in accordance with a second embodiment of the present invention. The header connector 1' has a configuration substantially the same as that of the header connector 1, except that the housing 2 defines a plurality of recesses 29' at the junction of each lateral wall 206 and the mounting face 202, and the shell 4 has a plurality of tabs 45' integrally formed on the lateral walls 412 and bent inwardly to be received in the recesses 29' of the housing 2. The tabs 45' can further stop the shell 4 from separating from the housing 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a pair of projections formed on opposite ends thereof, each projection having an outer head and an inner neck;

a plurality of terminals retained in the insulative housing; and a metal shell enclosing the insulative housing and comprising a pair of downwardly extending board locks, each board lock having a pair of spaced legs straddling the neck and abutting against the head of a corresponding projection;

wherein the neck is generally of a T-shaped configuration and has a large-dimensioned upper portion and a small-dimensioned lower portion, and wherein the board lock has a pair of inwardly extending barbs formed on inner sides of the spaced legs for latching beneath the upper portion and interfering with the lower portion of the neck;

wherein the housing defines a receiving cavity through a mating face thereof, and wherein each terminal includes a mating portion disposed in the receiving cavity for engaging with a corresponding terminal of a complementary connector;

wherein the housing defines a plurality of recesses in communication with the receiving cavity, and wherein the shell comprises a plurality of spring arms aligned with the recesses and extending downwardly into the receiving cavity;

wherein the housing defines a cutout in communication with the receiving cavity for engaging with a corresponding projection of a complementary connector;

wherein the housing comprises a protrusion disposed below the cutout, and the protrusion defines an aperture therein;

wherein the shell comprises a body portion and a pair of opposite end portions, each end portion including a downwardly extending extension, and the extensions being inserted in the aperture of the protrusion and closely abutting each other;

wherein the extensions have a plurality of barbs for interference fitting with the aperture of the insulative housing;

wherein the insulative housing defines a pair of grooves in communication with the receiving cavity, and wherein the shell comprises a pair of downwardly extending tags adjacent to the extensions for being secured in the grooves;

wherein the insulative housing defines another groove opposite to the cutout, and wherein the shell comprises another downwardly extending tag opposite to the extensions for being secured in the groove;

wherein the housing defines a plurality of outwardly exposed slots, and wherein the shell comprises a plurality of inwardly extending tongues for engaging with the slots;

wherein the housing has a plurality of protrusions, and wherein the shell has a pair of bottom edges abutting against the protrusions;

wherein the insulative housing defines a plurality of recesses on a mounting face thereof, and wherein the shell comprises a plurality of tabs integrally formed on opposite ends thereof and bent inwardly for being received in the recesses.

* * * * *